United States Patent [19]

Da Costa

[11] Patent Number: 5,007,813

[45] Date of Patent: Apr. 16, 1991

[54] ROTARY ROLLING PISTON COMPRESSOR WITH FIXED VANE HAVING A RELIEVED INCLINE SECTION

[75] Inventor: Caio N. F. N. Da Costa, Joinville, Brazil

[73] Assignee: Empresa Brasileira de Compressores S/A - Embraco, Joinville, Brazil

[21] Appl. No.: 365,176

[22] Filed: Jun. 12, 1989

[30] Foreign Application Priority Data

Jun. 15, 1988 [BR] Brazil ..... 8802997

[51] Int. Cl.[5] ..... F04C 18/356; F04C 29/02

[52] U.S. Cl. ..... 418/63; 418/96; 418/234; 418/248

[58] Field of Search ..... 418/63, 249, 234, 248, 418/96, 97

[56] References Cited

U.S. PATENT DOCUMENTS 3,463,090 8/1969 Gordinier ..... 418/249 X
3,985,473 10/1976 King et al. ..... 418/234 X

FOREIGN PATENT DOCUMENTS 58191 4/1984 Japan ..... 418/63
142086 7/1985 Japan ..... 418/63

*Primary Examiner*—John J. Vrablik
*Attorney, Agent, or Firm*—Darby & Darby

[57] ABSTRACT

A rotary rolling piston type compressor having a cylinder mounted in a hermetic shell and a rolling piston driven by a crankshaft carried by the rotor of an electric motor whose stator is fixed internally to the shell. An external part of the cylinder has a radial slot that houses a slidable vane which defines with the cylinder and the piston compression and a suction chamber. The vane surface facing the suction chamber has a planar surface on its upper portion parallel to the vane surface facing the compression chamber and the lower portion of the surface facing the suction chamber has a relieved, or chamfered, section(s). The chamfered surface(s) develops a hydrodynamic wedge effect upon the vane during downward displacement, increasing the lubricating and stability capacity of the vane against the wall of the slot in which the vane slides, and reduces the area of the vane which is in actual contact with the wall of the slot.

11 Claims, 5 Drawing Sheets

ROTARY ROLLING PISTON COMPRESSOR WITH FIXED VANE HAVING A RELIEVED INCLINE SECTION

BACKGROUND OF THE INVENTION

The present invention relates to a rotary rolling piston compressor with a fixed vane, and more specifically to a new construction for the vane of this type of compressor.

In rotary rolling piston type compressors the fixed sliding vane does the separation of two chambers in the interior of the cylinder, a suction chamber at low pressure and a high pressure chamber or a discharge one. This separation is obtained as the vane top end follows the rolling piston movement under the influence of a biasing member. Due to the fact of separating two chambers with great pressure difference, the vane is forced against the sliding slot surface by the high pressure side. This causes problems of metallic contact and wear between the vane and the sliding slot.

One of the known solutions tries to reduce this problem through the improvement of the vane lubricating system, especially where the metallic contact occurs. This is the case of the U.S. Pat. No. 4,629,403 (TECUMSEH).

Another attempt is to reduce the pressure difference between the chambers at the end of the compression cycle is shown in U.S. Pat. No. 4,664,608 (G.E.).

Although these solutions reduce the problem of the wear between the vane and the sliding slot, they give rise to losses of volumetric efficiency of the compressor.

In the first above-mentioned solution (U.S. Pat. No. 4,629,403), the placing of a lubricating hole with oil at high pressure, connected to the low pressure or suction chamber through the clearance for the sliding of the vane at the slot, causes the leakage of this oil to the interior of the cylinder. This increases the fluid refrigerant temperature in the suction chamber, reducing its volumetric efficiency.

According to the first solution, the aim is to reduce the wear between the vane and the slot through the provision of lubrication in the places where the wear of the parts occurs. However, in spite of reducing the problem of wear between the vane and the slot, this first solution requires a lubricating oil flow in a volume that becomes prejudicial to the compressor efficiency because it leaks into the suction chamber during a large part or all of the compression cycle resulting in the inadequate heating of the fluid refrigerant.

On the second solution the opening of the orifice for the pressure release will always take place at a given rotation angle of the crankshaft, whether the discharge pressure has been reached inside the cylinder or not, which depends on the operational condition in which the compressor is applied. This may cause backflow of the refrigerant gas already discharged in the housing back to the interior of the cylinder. This obviously adversely affects the energy and volumetric efficiency of the compressor.

OBJECTS OF THE INVENTION

It is an object of the present invention to reduce the metallic contact and the wear between the vane and the sliding slot in a rotary rolling piston type compressor without causing losses in the energy and volumetric efficiency of the compressor.

It is also an object of the present invention to present a solution which does not alter the normal operation condition of the compressor.

BRIEF DESCRIPTION OF THE INVENTION

The rotary rolling piston compressor which is the object of the present invention includes a hermetic shell or housing in whose interior a cylinder is fixedly mounted. The cylinder houses a rolling piston driven by a crankshaft mounted to the rotor of an electric motor whose stator is mounted to the shell. The cylinder has a radial slot housing a vane having one end riding on the rolling piston surface, such a vane defining, in each of its opposite sides, suction and compression chambers in the interior of the cylinder.

According to the present invention the face of the vane turned to the suction chamber side has on its upper portion and on at least a part of its lower portion, at least two distinct surfaces. The upper portion has a planar face parallel to the face of vane turned to the compression chamber side and, at least part of the lower portion has an inclined surface relative to the vane face turned to the compression chamber side.

The above-mentioned construction allows the vane to act with the effect of a hydrodynamic wedge, causing on the suction side of the vane a contrary force to the one applied to the vane side turned to the compression chamber, so as to balance the transverse forces exerted on the vane in terms of the existent pressure (Pc) in the compression chamber.

The above construction improves considerably the load-carrying capacity or support of the vane in the interior of the sliding slot, thereby facilitating its reciprocating displacement and making the sliding of the vane against the slot wall on the suction side smoother, especially in the area where the greatest wear by metallic contact would occur. It should be understood that the space between the vane and the sliding slot turned to the suction chamber side is, in normal operation, partially taken by oil, allowing the vane to act in a condition of a hydrodynamic wedge.

In the present invention the oil contained in the sliding slot is used as hydraulic means in order to minimize the instability of transverse forces on the vane and also, as a lubricant means to reduce even more the wear of the parts on the points of greater loads.

With this new construction, a substantial reduction on the metallic contact and on the wear of the vane and the sliding slot is obtained without causing any relevant increase of temperature of the fluid refrigerant in the interior of the suction chamber.

BRIEF DESCRIPTION OF THE DRAWINGS

The invention will be described as follows by making reference to the accompanying drawings, wherein.

DETAILED DESCRIPTION OF THE INVENTION

Figure 1:
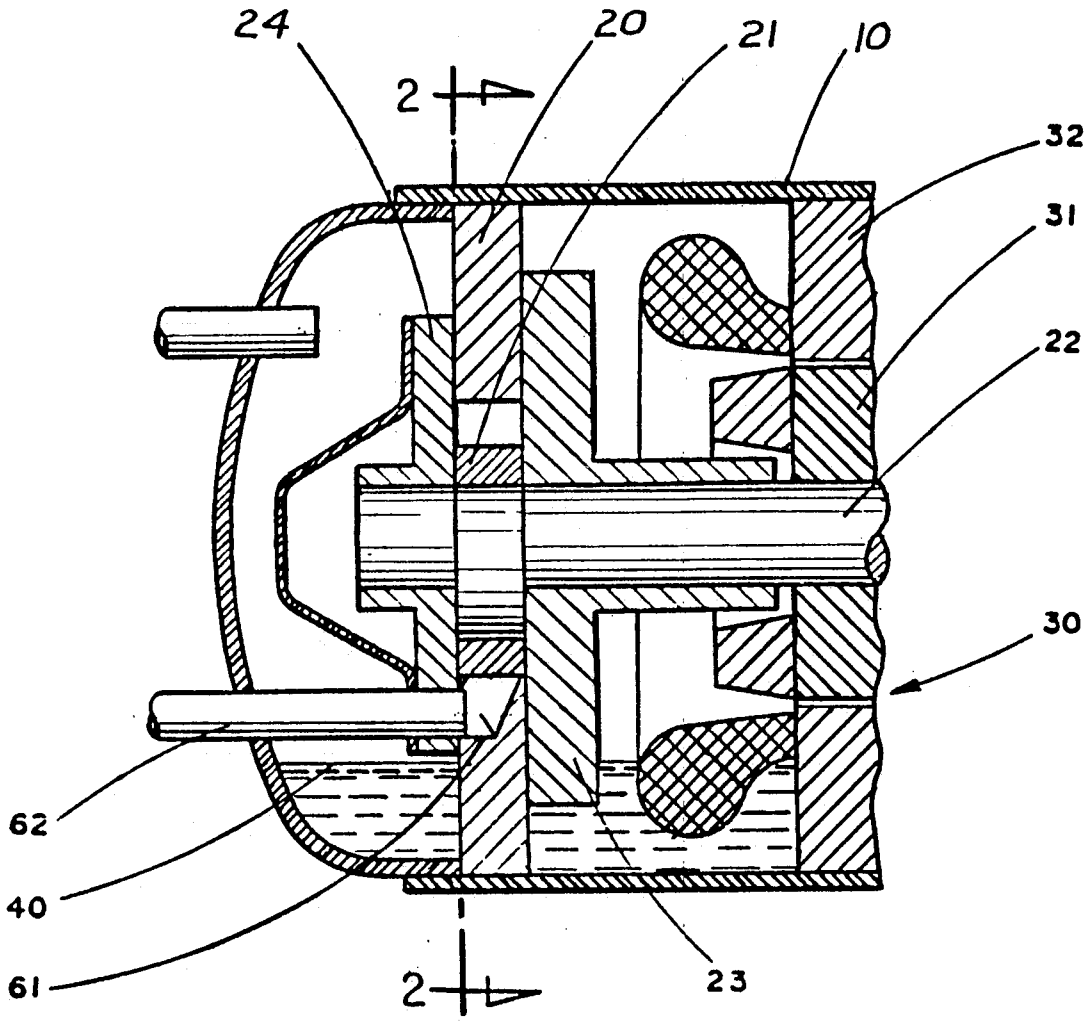
FIG. 1 represents a partial vertical longitudinal sectional view of a rotary rolling piston hermetic compressor embodying a sliding vane constructed in accordance with the present invention.

According to the above-mentioned illustrations the rotary hermetic compressor comprises a cylindrical shell or housing 10 in whose interior a cylinder 20 is fixedly mounted. A rolling piston 21 having an eccentric position rotates within the cylinder and is driven by a crankshaft 22, which is supported by a main bearing 23 and a sub bearing 24, mounted to the housing, one on each side of the cylinder. The shaft 22 is driven by rotor 31 of an electric motor 30 whose stator 32 is fixedly mounted on the internal wall of the shell 10.

The lower part of the wall of cylinder 20 is provided with a radial slot (FIGS. 2–4) in which a vane 25 is housed for reciprocating motion. The free end of the vane 29 is constantly forced by a spring 26 acting on its other end into a sliding relationship against the outer surface of rolling piston 21. The vane reciprocates alternately up and down in the interior of the sliding slot as the piston 21 rotates.

Figure 2:
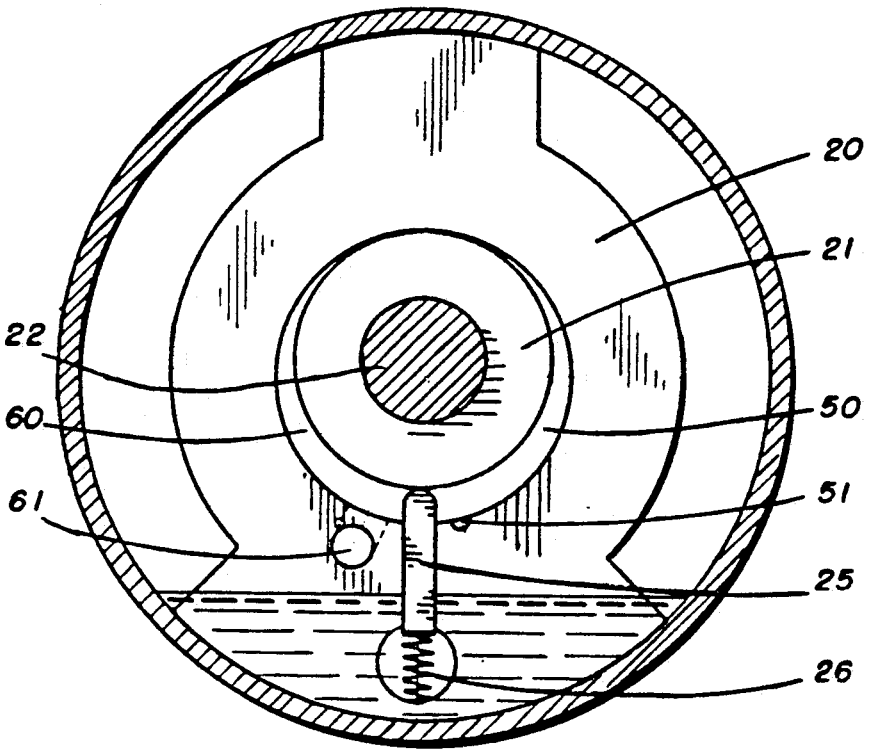
FIG. 2 illustrates a partial sectional view taken along lines II—II of FIG. 1.

The interior of the shell 10 functions as an oil sump 40 necessary to the lubrication of the mechanical components of the compressor. As shown in FIG. 2, the oil level in the sump is above the lower end of the vane and communicates with the opening holding the lower end of the spring as well as the lower end of the slot. The interior of the sealed housing is at a high pressure (the discharge pressure) and this forces the oil into the vane slot, especially on the suction volume side of the vane, as well as into the interior of the cylinder. This is conventional in compressors of this type.

According to FIG. 2, the vane 25 defines with the interior of the cylinder 20 around the rolling piston 21 and between the internal faces of the main bearing 23 and sub bearing 24, a compression chamber 50, having a discharge opening 51 which is in communication with the interior of the shell 10 through an orifice formed on the sub bearing 24. The vane also defines with the cylinder and the bearings a suction chamber 60 containing a suction hole 61 disposed through the sub bearing 24 and to which a suction tube 62 (FIG. 1) is connected.

Figure 4:
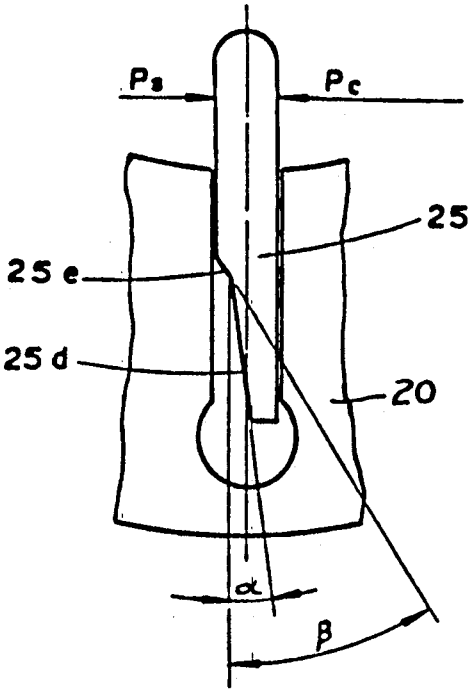
FIGS. 3 and 4 are enlarged lateral views of two configurations of vanes of the present invention when they are housed on the respective sliding slot of the cylinder, also illustrating by the representative arrows the suction (Ps) and compression (Pc) pressure performance on the opposite sides of the vane.
Figure 3:
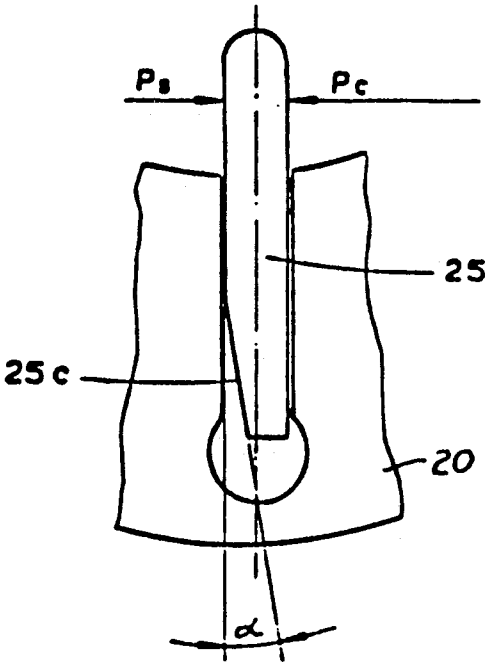

In the configuration of the vane shown in FIG. 3 and FIG. 4, the spring 26 is not shown at the lower end of the vane for purpose of clarity. In the embodiment of FIG. 3, the side of the vane in communication with the suction chamber has approximately its lower half which is adjacent spring 26 relieved by a chamfer **25*c*** that occupies about half of the total height of the vane and is disposed on an inclined plane at an angle $\alpha$ of approximately 5° to the vertical. The planar face of the upper part of the vane suction side is generally parallel to the face on the opposite compression side.

In the configuration shown in FIG. 4, the vane suction side has approximately its lower half defined by two overlaid chamfers **25*d* and 25*e*, each one of those occupying the total width of the vane. The smaller height upper chamfered area 25*e* is disposed on a plane which is at a steeper angle to the vertical than the plane of the lower and longer height chamfer section 25*d*. The relieved chamfered section again occupies about the lower half of the vane. The upper half of the vane face on the suction side is generally parallel to the face on the compression side. The maximum relief, i.e., the thinnest part of the vane, is about one-half of the maximum thickness. The angle $\alpha$ for Section 25*d* of approximately 5° of FIG. 3** is also shown.

Figure 5:
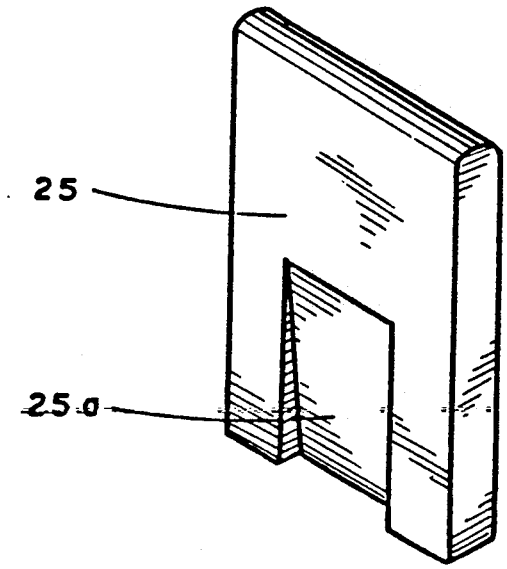
FIG. 5 is a perspective view of a third configuration of the vane.

In the embodiment of FIG. 5, the vane 25 has its side which communicates with the suction chamber provided with a recessed central chamfer **25*a* whose height is approximately equal to the lower half of the suction side and it is disposed on a slope to the inside of the vane and containing the suction side toward the lower edge of reduced thickness of the vane. The width of this central chamfer 25*a*** is preferably about $\frac{1}{3}$ of the vane width leaving about $\frac{1}{3}$ on each side of the chamfer with the original vane configuration. Again, the upper part of the vane face on the suction side is generally parallel to the compression side vane face.

Figure 6:
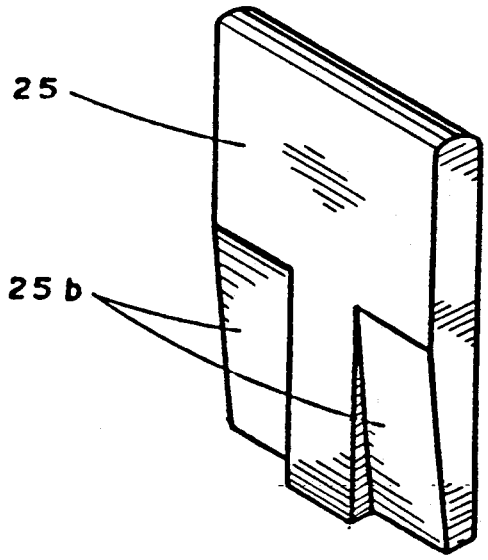
FIG. 6 is a perspective view of a fourth configuration of the vane.

In the embodiment of FIG. 6, the central bevel **25*a* of FIG. 5 is replaced by a pair of bevels 25*b*, one on each side of the vane, also occupying, regarding height, approximately the lower half of the vane 25 on the suction side and having the same slope. Each bevel has a width of about $\frac{1}{3}$ of the vane. The lower edge of reduced thickness of the vane of the two lateral bevels 25*b* is tapered down to about $\frac{1}{3}$ of the vane thickness. The two inclined planes of the bevels 25*b*** are parallel to each other on the lower part of the suction side of the vane.

In the embodiment of FIGS. 5 and 6 the double chamfer configuration of FIG. 4 can be used for the bevels **25*a* and 25*b***.

Figure 7:
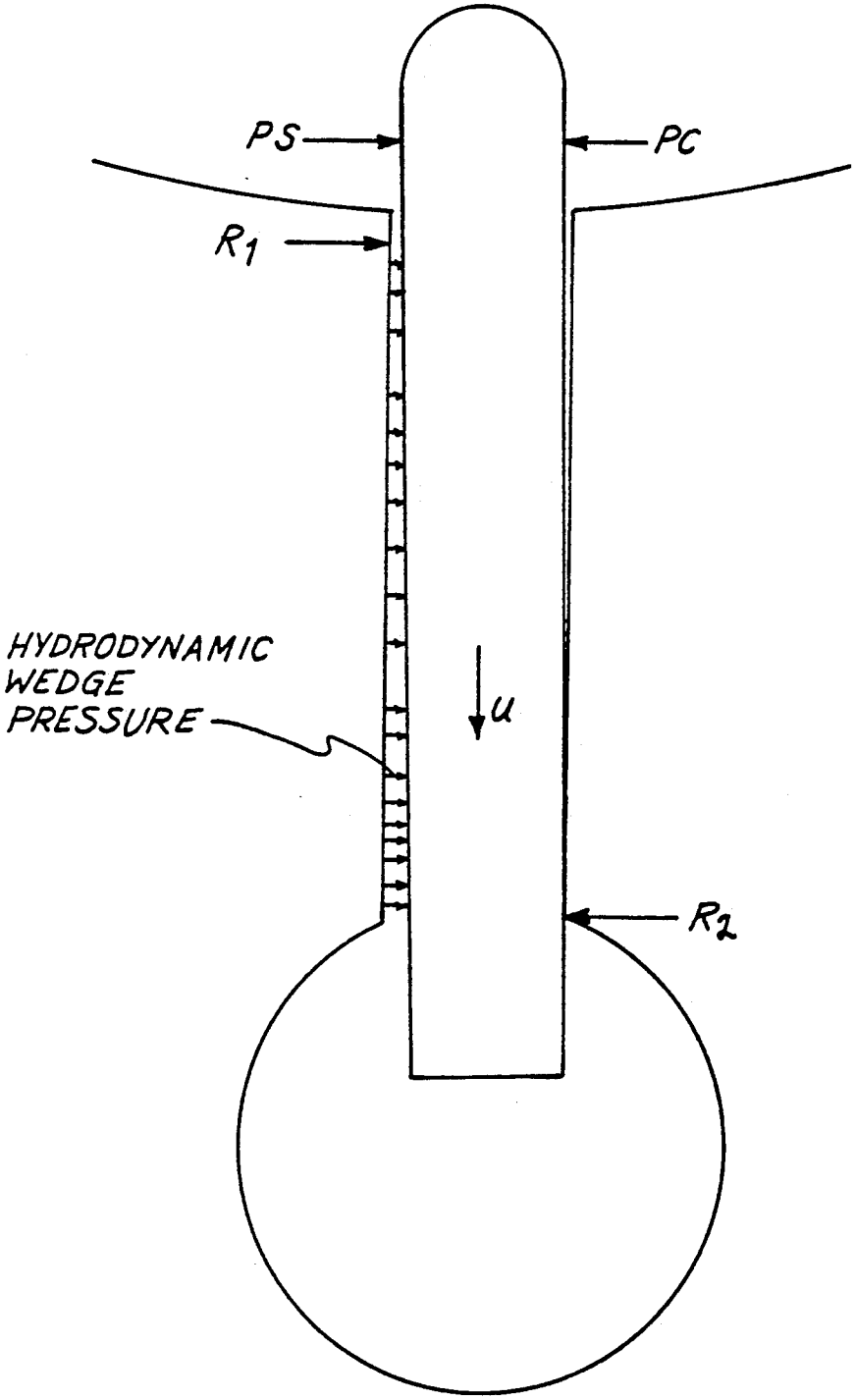
FIG. 7 is a schematic drawing showing the hydrodynamic wedge pressure effect.

Referring to FIG. 7, as previously described, the suction chamber side of the vane has, on its lower portion which is within the walls of the slot, at least one relieved inclined section forming an angle not greater than 5° (preferably around 2°) in relation to the planar upper portion of the vane suction chamber side. The angle of inclination of the relieved section is sufficiently small to allow the vane to be displaced downwardly into the slot without receiving a transverse force on its lower end of an amount to cause a change in the reciprocation direction of the vane. That is, the slightly inclined lower surface of the vane has no relevant influence of the reciprocating direction of the vane.

However, the slightly inclined lower surface of the vane defines a hydrodynamic wedge in conjunction with the lubricating oil existing inside the slot when the vane is being displaced downwardly into the slot. The hydrodynamic wedge moves as the vane is displaced downwardly. The moving hydrodynamic wedge has the known property of build-up of a film of oil between the wedge and the adjacent wall (suction side wall of the slot) with a considerable carrying power. That is, it exerts a substantial pressure on the suction side of the vane. This is shown in FIG. 7 by the small arrows (left side of the vane, as shown) transverse to the longitudinal axis of the vane.

The structure is not intended to create a transverse force at the lower edge of the vane on the compression side, parallel and having the same direction as the resulting transverse force acting on the upper portion of the vane inside the cylinder. Instead, it acts to build-up the pressure of the oil film between the suction side of the vane and the adjacent wall of the slot, when the vane is being displaced downwardly into the slot in order to decrease the value of the reaction transverse force $R_1$ (FIG. 7) at the upper portion of the suction side wall of the slot in which the greater wear occur. A slight increase in the lower transverse reaction force $R_2$ will occur, but this lower reaction force $R_2$ is considerably less than the value $R_1$, and acts on a region of less wear on the compression side wall of the slot.

It is the increased carrying power of the oil film at the suction side of the vane, i.e. the hydrodynamic wedge, which avoids the direct contact between the suction side of the vane and the adjacent wall of the slot.

With this new construction, upon the vane descending in its slot during sliding displacement, with the suction side chamfered at the lower part, the inclined plane of the chamfer(s) begins to develop a hydrodynamic wedge effect. This increases the support and lubrication capacity of the vane on the suction chamfer side against the slot wall on which it slides. This characteristic of the new construction and the fact that part of the vane is chamfered so that it does not have a metallic contact with the slot wall reduces the metallic contact between the vane and the sliding slot wall by the suction chamber side and, improves the vane and slot lubrication. With it, the compressor life-time is increased because it reduces the wear of its most critical part which is the vane.

The hydrodynamic wedge effect also makes possible a smoother and more perfect sliding, without vibrations of the vane in the slot. For this reason, this construction of the invention provides a reduction of the noise level generated by the compressor, especially at high frequencies.

I claim:

1. A rotary rolling piston compressor comprising:

a shell, a cylinder mounted within said shell, a piston having an eccentric portion for rotation within said cylinder, a shaft for rotating said piston, a slot formed on an external part of said cylinder, the shell containing lubricating oil which is also in the slot, a vane whose lower end is within said slot, means for biasing the vane lower end to provide for reciprocating motion between the slot walls as the vane upper end rides against the rotating piston, the vane defining with the cylinder and piston on one side of the vane a suction chamber and on the other side a compression chamber, the upper portion of the vane on the suction chamber side being planar in a plane parallel to the face of the compression chamber side of the vane, the lower portion of said vane on the suction chamber side having at least one relieved inclined section of not more than about 5° to the vertical axis of the vane which is within the walls of the slot to produce a hydrodynamic wedge with the lubricating oil between the inclined section and the side wall of the slot on the suction chamber side as the vane moves down toward the lower end of the slot.

2. A compressor as in claim 1 wherein the relieved inclined section is about one half the height of the vane.

3. A compressor as in claim 1 wherein the relieved inclined section tapers to a thickness of about one half the thickness of the vane.

4. A compressor as in claim 1 wherein there is one relieved inclined section extending across the width of the vane.

5. A compressor as in claim 1 wherein said relieved inclined section extends across only a part of the center of the vane and there is an unrelieved section on each side thereof.

6. A compressor as in claim 5 wherein the relieved inclined section of the center of the lower portion of the vane extends across about one third of the width of the vane.

7. A compressor as in claim 1 wherein there are a pair of said relieved inclined sections, one on each side on an unrelieved center section.

8. A compressor as in claim 7 wherein the relieved inclined sections and the unrelieved central section each have approximately the same width.

9. A compressor as in claim 1 wherein a relieved inclined section has first and second portions, each being at a different angle of inclination relative to the longitudinal axis of the vane.

10. A compressor as in claim 9 wherein said first portion is closer to the upper end of the vane and has a steeper angle of inclination than said second portion.

11. A compressor as in claim 10 wherein said upper inclined portion is of smaller length than said lower portion.

* * * * *